US006873117B2

(12) United States Patent
Ishizuka

(10) Patent No.: US 6,873,117 B2
(45) Date of Patent: Mar. 29, 2005

(54) DISPLAY PANEL AND DISPLAY DEVICE

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/672,076

(22) Filed: Sep. 29, 2003

(65) Prior Publication Data

US 2004/0130545 A1 Jul. 8, 2004

(30) Foreign Application Priority Data

Sep. 30, 2002 (JP) ..... 2002-285706

(51) Int. Cl.[7] ..... G09G 3/10

(52) U.S. Cl. ..... 315/169.1; 315/169.3; 345/76; 345/77; 345/84

(58) Field of Search ..... 315/169.1, 169.3, 315/312, 318, 320, 291, 294; 345/76, 77, 84, 211–213

(56) References Cited

U.S. PATENT DOCUMENTS 6,281,634 B1 * 8/2001 Yokoyama ..... 315/169.3
6,380,688 B1 * 4/2002 Bae et al. ..... 315/169.3
6,633,270 B2 * 10/2003 Hashimoto ..... 345/76
6,686,699 B2 * 2/2004 Yumoto ..... 315/169.3
6,771,028 B1 * 8/2004 Winters ..... 315/169.1
2003/0122813 A1 * 7/2003 Ishizuki et al. ..... 345/211

* cited by examiner

*Primary Examiner*—Haissa Philogene
(74) *Attorney, Agent, or Firm*—Morgan, Lewis & Bockius LLP

(57) ABSTRACT

An active type of display panel arranged with light-emitting elements such as organic electroluminescent elements, capable of effecting correct tonal display even during a long-time use, a display device using the display panel and a method of driving the display panel. In each of pixel portions on the display panel, a driving element is activated according to a data signal, to supply a light-emitting element with a drive current in an amount corresponding to the data signal. The data signal is corrected such that the drive current becomes equal to a current corresponding to a light-emitting luminance represented by the data signal.

8 Claims, 8 Drawing Sheets

DISPLAY PANEL AND DISPLAY DEVICE

BACKGROUND OF THE INVENTION

1. Field of the Invention

The present invention relates to an active type of display panel using light-emitting elements such as organic electroluminescent elements, a display device using the display panel and a method for driving the display panel.

2. Description of the Related Art

Electroluminescence display devices (referred to as EL display devices hereinafter) mounted with a display panel employing organic electroluminescence elements (referred to simply as EL elements hereinafter) in the form of light emitting elements carrying pixels are currently attracting attention. Known systems for driving display panels by means of these EL display devices include simple matrix type and active matrix type systems. In comparison with simple matrix type systems, active matrix type EL display devices consume very little electrical power and afford advantages such as low cross-talk between pixels, and are particularly suitable as large screen display devices and high definition display devices, and so forth.

As shown in FIG. 1, EL display devices are constituted by a display panel 1, and a driving device 2 for driving the display panel 1 in accordance with an image signal.

The display panel 1 is formed having an anode power line 3, a cathode power line 4, m data lines (data electrodes) A1 to Am arranged in parallel so as to extend in the perpendicular (vertical) direction of one screen, and n horizontal scanning lines (scanning electrodes) B1 to Bn for one screen which are orthogonal to the data lines A1 to Am. A drive voltage Vc is applied to the anode power line 3 and a ground potential GND is applied to the cathode power line 4. Further, pixel portions $E_{1.1}$ to $E_{m.n}$ each carrying one pixel are formed at the points of intersection between the data lines A1 to Am and the scanning lines B1 to Bn of the display panel 1.

The pixel portions $E_{1.1}$ to $E_{m.n}$ have the same constitution and are constituted as shown in FIG. 2. That is, the scanning line B is connected to the gate G of a scanning line selection FET (Field Effect Transistors) 11, and the data line A is connected to the drain D thereof. The gate G of a FET 12, which is a light emission drive transistor, is connected to the source S of the FET 11. When the drive voltage Vc is applied via the anode power line 3 to the source S of the FET 12, a capacitor 13 is connected between this gate G and source S. In addition, the anode terminal of the EL element 15 is connected to the drain D of the FET 12. A ground potential GND is applied through the cathode power line 4 to the cathode terminal of the EL element 15.

The driving device 2 applies a scanning pulse sequentially and alternatively to the scanning lines B1 to Bn of the display panel 1. In addition, the driving device 2 generates, in sync with the application timing of the scanning pulse, pixel data pulses $DP_1$ to DPm which are dependent on the input image signals corresponding to the horizontal scanning lines, and applies these pulses to the data lines A1 to Am respectively. The pixel data pulses DP each have a pulse voltage which is dependent on the luminance level indicated by the corresponding input image signal. The pixel portions which are connected on the scanning line B to which the scanning pulse is applied are the write targets of this pixel data. The FET 11 in a pixel portion E which is the write target of this pixel data assumes an on state in accordance with the scanning pulse such that the pixel data pulse DP supplied via the data line A is applied to the gate G and to the capacitor 13 of the FET 12. The FET 12 generates a light emission drive current which is dependent on the pulse voltage of this pixel data pulse DP and supplies this drive current to the EL element 15. In response to this light emission drive current, the EL element 15 emits light at a luminance which is dependent on the pulse voltage of the pixel data pulse DP. Meanwhile, the capacitor 13 is charged by the pulse voltage of the pixel data pulse DP. As a result of this recharging operation, a voltage that depends on the luminance level indicated by the input image signal is stored in the capacitor 13 and so-called pixel data writing is then executed. Here, when discharge from the pixel data write target takes place, the FET 11 enters an off state, and the supply of the pixel data pulse DP to the gate G of the FET 12 is halted. However, because the voltage stored in the capacitor 13 as described above is continuously applied to the gate G of the FET 12, the FET 12 continues to cause a light emission drive current to flow to the EL element 15.

The light emission luminance of the EL elements 15 of each of the pixel portions $E_{1.1}$ to $E_{m.n}$ depends on the voltage which is stored in the capacitor 13 as described above according to the pulse voltage of the pixel data pulse DP. In other words, the voltage stored in the capacitor 13 is the gate voltage of the FET 12 and therefore the FET 12 causes a drive current (drain current Id) that is dependent on the gate-source voltage Vgs to flow to the EL element 15. The relationship between the gate-source voltage Vgs of the FET 12 and the drain current Id is as shown in FIG. 3, for example. The flow of drive current through the EL element 15, which current is at a level that is dependent on the level of the voltage stored in the capacitor 13, constitutes the light emission luminance that depends on the level of the voltage stored in the capacitor 13. Thus, the EL display device is capable of a gray level display.

In a drive transistor such as the FET 12, the characteristic for the relationship between the gate-source voltage Vgs and the drain current Id changes according to temperature changes and inconsistencies in the transistor itself. For example, in cases where characteristics (characteristics indicated by solid lines) deviate from the standard characteristic (broken line) as shown in FIG. 4, the respective drain currents Id are different for the same gate-source voltage Vgs, and therefore the EL element cannot be caused to emit light at the desired luminance.

A voltage change range for the gate-source voltage Vgs with respect to the luminance change range which is required for the gray level display is established beforehand. If the characteristic for the relationship between the gate-source voltage Vgs and the drain current Id is standard, the current change range of the drain current Id with respect to the voltage change range of the gate-source voltage Vgs is as shown in FIG. 5A. The current change range of the drain current Id shown in FIG. 5A is a range that corresponds to the luminance change range required for the gray level display. On the other hand, in cases where there is a change in the relationship characteristic, the current change range of the drain current Id with respect to the pre-established voltage change range of the gate-source voltage Vgs differs from the luminance change range required for the gray level display shown in FIG. 5A, as shown in FIGS. 5B and 5C. Therefore, when there is a variation in the drive current characteristic with respect to the input control voltage as a result of a drive transistor temperature variation and inconsistencies in the transistor itself, a correct gray level display is not possible.

SUMMARY OF THE INVENTION

Accordingly, an object of the present invention is to provide an active type of display panel in which light emitting elements such as organic electroluminescence elements are disposed in the form of a matrix and which is capable of implementing a correct gray level display even when used for a long period, and to provide a display device that employs the display panel and a driving method for the display panel.

A display panel of the present invention is an active type of display panel having a plurality of pixel portions which are each formed by a series circuit having a light-emitting element and a driving element and divided into a plurality of groups, the display panel comprising: a reference potential line connected to one ends of the series circuits of the plurality of pixel portions; a first power line provided in common for the plurality of pixel portions; and a second power line provided for each of the plurality of groups; wherein each of the plurality of pixel portions has a switch device for electrically connecting between the other end of the series circuit and the first power line, and electrically connecting between the other end of the series circuit and the second power line of a corresponding group of the plurality of pixel portions.

A display device of the present invention comprising: an active type of display panel having a plurality of data lines arranged in columns, a plurality of scanning lines arranged in rows to intersect with the plurality of data lines, and pixel portions arranged at the respective intersections between the plurality of data lines and the plurality of scanning lines, each of the pixel portions including a series circuit which has a light-emitting element and a driving element; and a display controller, in accordance with an input image signal, for sequentially designating one scanning line of the plurality of scanning lines in predetermined intervals, supplying a scanning pulse to the one scanning line, and supplying a data signal representative of a light-emission luminance onto at least one data line of the plurality of data lines in a scanning period when the scanning pulse is supplied to the one scanning line; wherein each of the pixel portions has a holding device which holds the data signal, and a pixel controller which activates the driving element in accordance with the data signal held in the holding device, to supply a drive current at a level corresponding to the data signal to the light-emitting element; and wherein the display controller has a drive current detector which detects the drive current in the scanning period, and a data correcting device which corrects the data signal held in the holding device such that the drive current detected in the scanning period by the drive current detector becomes equal to a current level corresponding to a light-emitting luminance represented by the data signal.

A display panel driving method of the invention is a method for driving an active type of display panel having a plurality of data lines arranged in columns, a plurality of scanning lines arranged in rows to intersect with the plurality of data lines, and pixel portions arranged at respective intersections between the plurality of data lines and the plurality of scanning lines, each of the pixel portions including a series circuit which has a light-emitting element and a driving element, the driving method comprising the steps of: in accordance with an input image signal, sequentially designating one scanning line of the plurality of scanning lines in predetermined intervals, supplying a scanning pulse to the one scanning line, and supplying a data signal representative of a light-emission luminance onto at least one data line of the plurality of data lines in a scanning period when the scanning pulse is supplied to the one scanning line; holding the data signal in each of the pixel portions; activating the driving element in accordance with the held data signal, to supply a drive current at a level corresponding to the data signal to the light-emitting element; detecting the drive current in the scanning period, and correcting the held data signal such that the drive current detected in the scanning period becomes equal to a current level corresponding to a light-emitting luminance represented by the data signal.

DETAILED DESCRIPTION OF THE INVENTION

The present invention will be described below in more detail with reference to the accompanying drawings in accordance with the embodiment.

Figure 1:
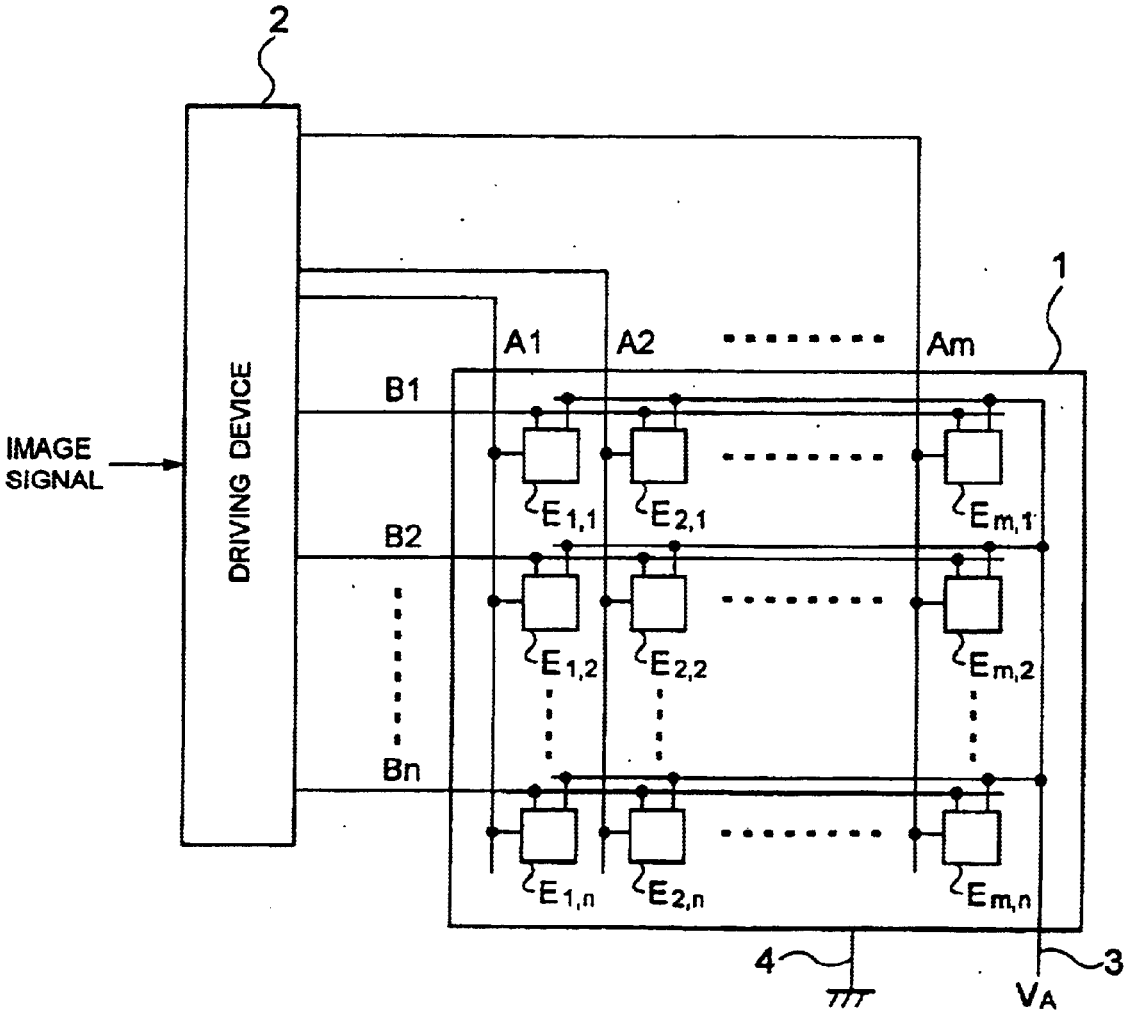
FIG. 1 PRIOR ART
FIG. 1 is a block diagram showing the constitution of a conventional EL display device.
Figure 2:
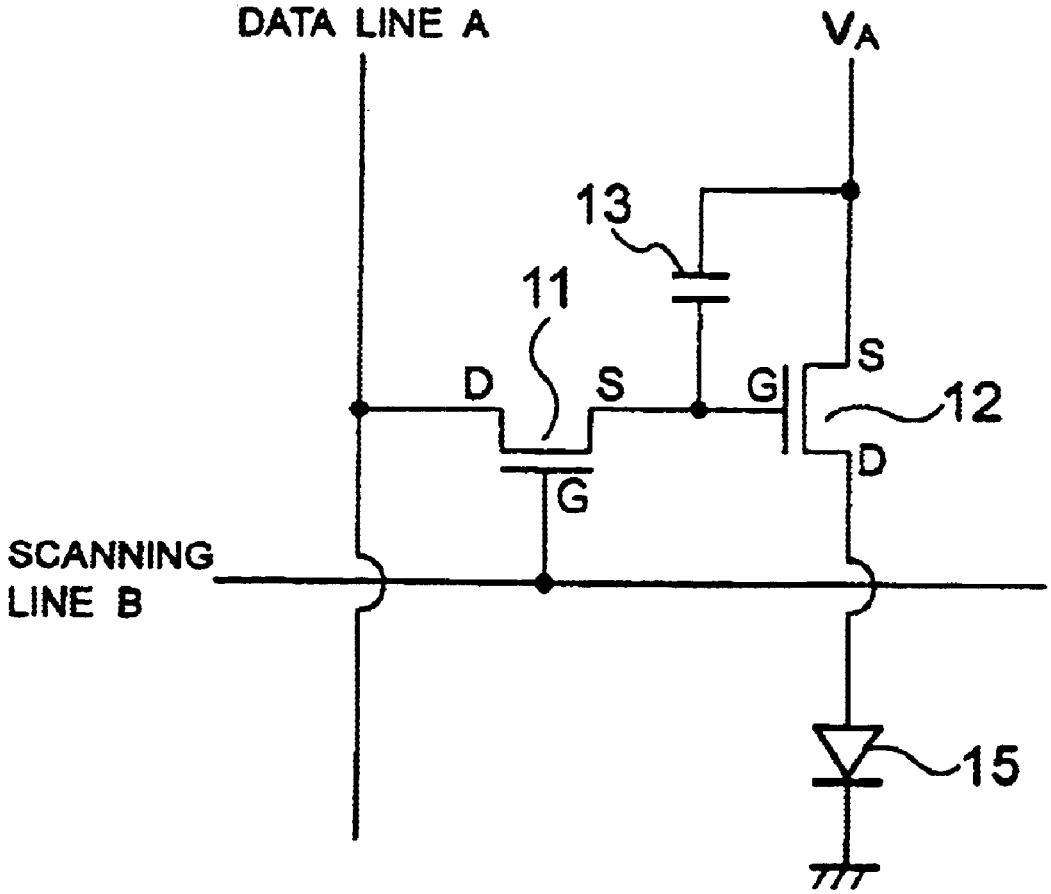
FIG. 2 PRIOR ART
FIG. 2 is a circuit diagram showing the constitution of a pixel portion in FIG. 1.
Figure 3:
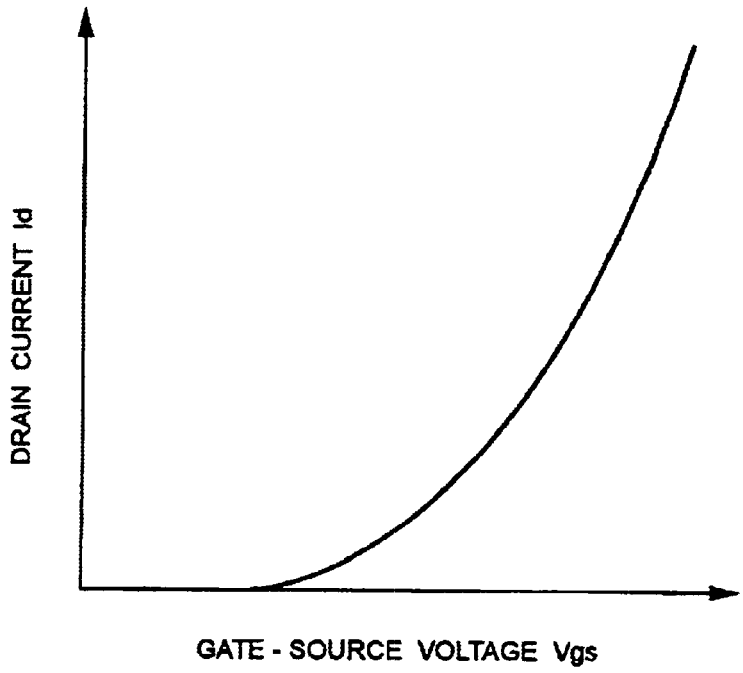
FIG. 3 shows the gate-source voltage/drain current characteristic of an FET in a pixel portion.
Figure 4:
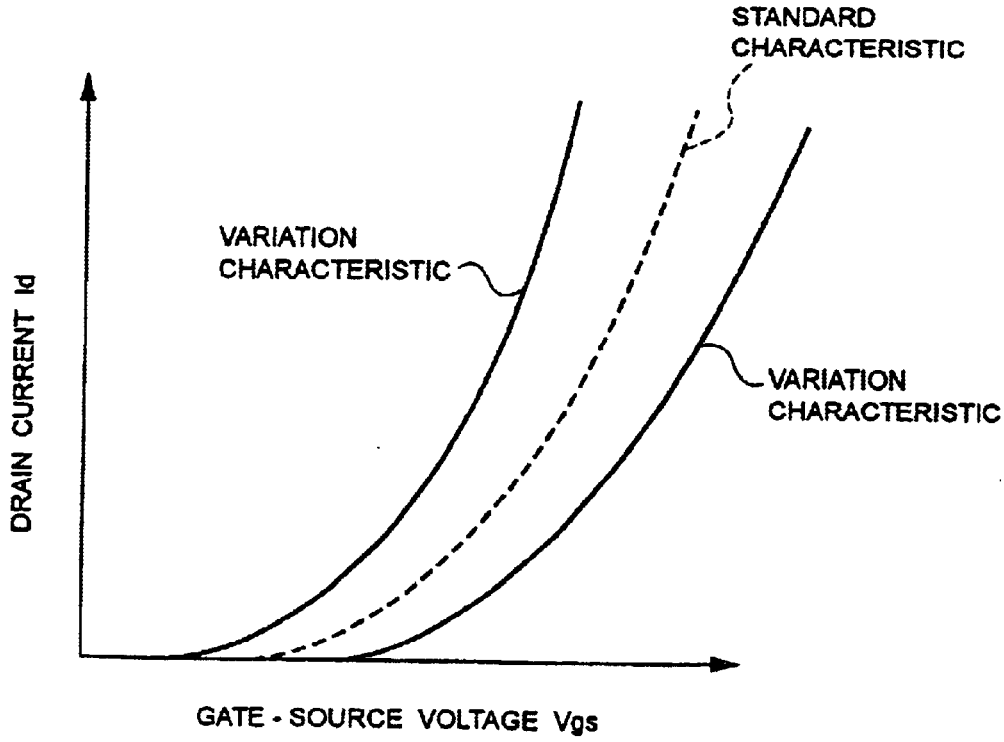
FIG. 4 shows changes in the gate-source voltage/drain current characteristic.
Figure 5A:
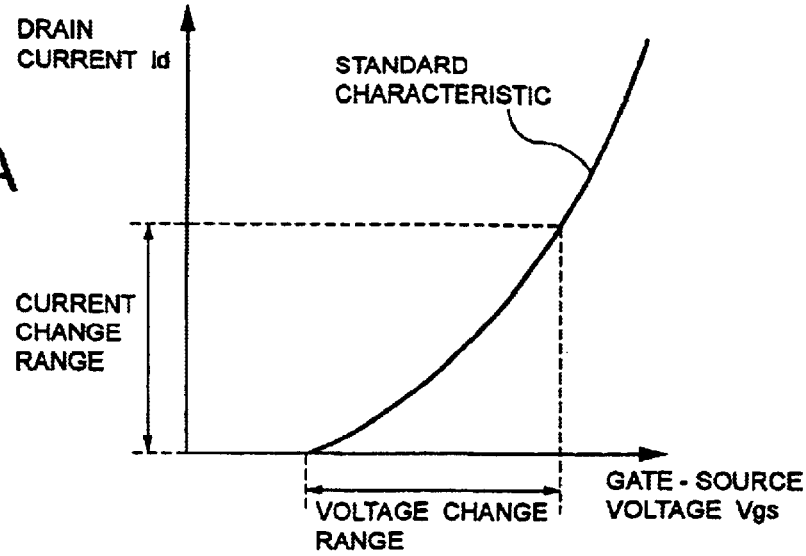
FIGS. 5A to 5C each show a relationship between a drain current change range and a change range for the gate-source voltage.
Figure 5B:
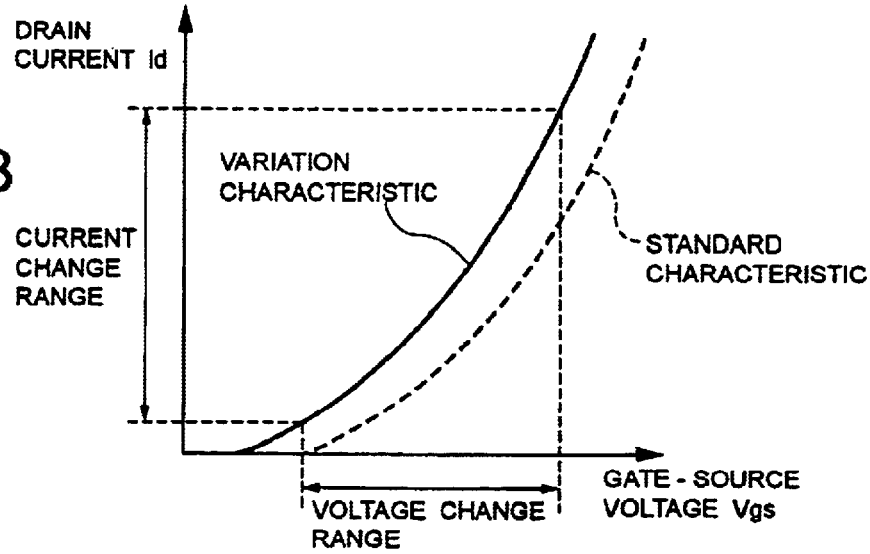
Figure 5C:
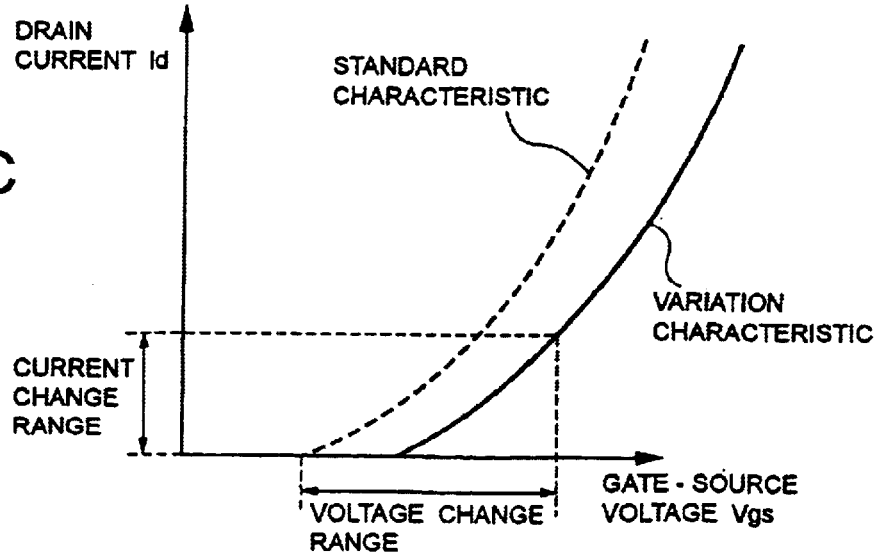
Figure 6:
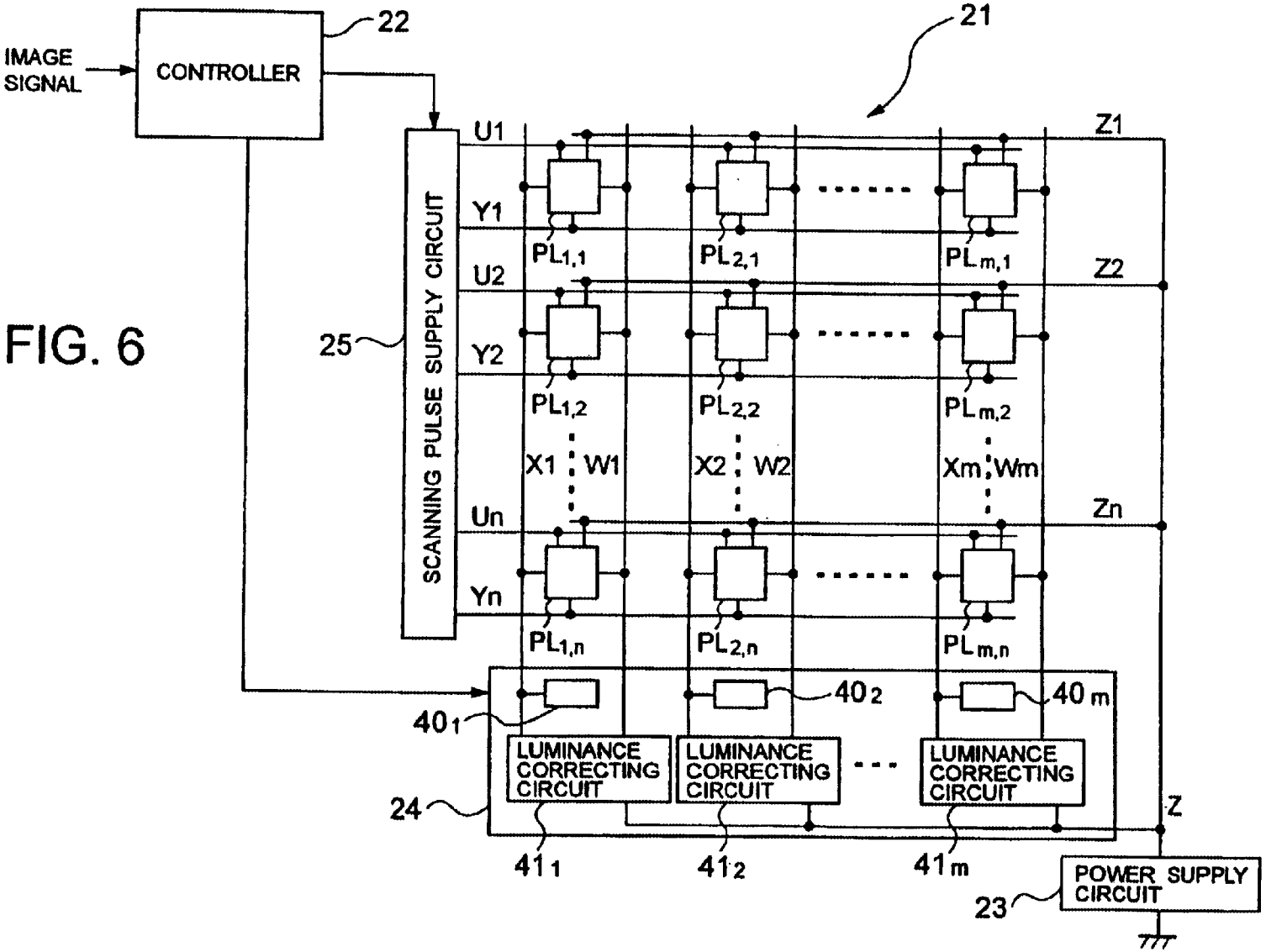
FIG. 6 is a block diagram showing the constitution of a display device to which the present invention is applied.

FIG. 6 shows an EL display device to which the present invention is applied. The display device includes a display panel 21, a controller 22, a power supply circuit 23, a data signal supply circuit 24 and a scanning pulse supply circuit 25.

The display panel 21 has a plurality of data lines X1–Xm (m is an integer of two or greater) arranged in parallel, a plurality of scanning lines Y1–Yn (n is an integer of two or greater) and a plurality of power lines (first power lines) Z1–Zn. The display panel 21, furthermore, has a plurality of scanning lines U1–Un and a plurality of power lines (second power lines) W1–Wm.

The plurality of data lines X1–Xm and the plurality of power lines W1–Wm are arranged in parallel, as shown in FIG. 6. Similarly, the plurality of scanning lines Y1–Yn, U1–Un and the plurality of power lines Z1–Zn are arranged in parallel, as shown in FIG. 6. The plurality of data lines X1–Xm and the plurality of power lines W1–Wm mutually intersect with the plurality of scanning lines Y1–Yn, U1–Un and plurality of power lines Z1–Zn. Pixel portions $PL_{1.1}$–$PL_{m.n}$ are respectively arranged at the intersections, thus forming a matrix display panel. The power lines Z1–Zn are mutually connected to one anode power line Z. The power line Z is supplied with a drive voltage VA as a power voltage from the power supply circuit 23. The display panel 21 is provided with a cathode power line, i.e. ground line, though not shown, besides the anode power lines Z1–Zn, Z.

Figure 7:
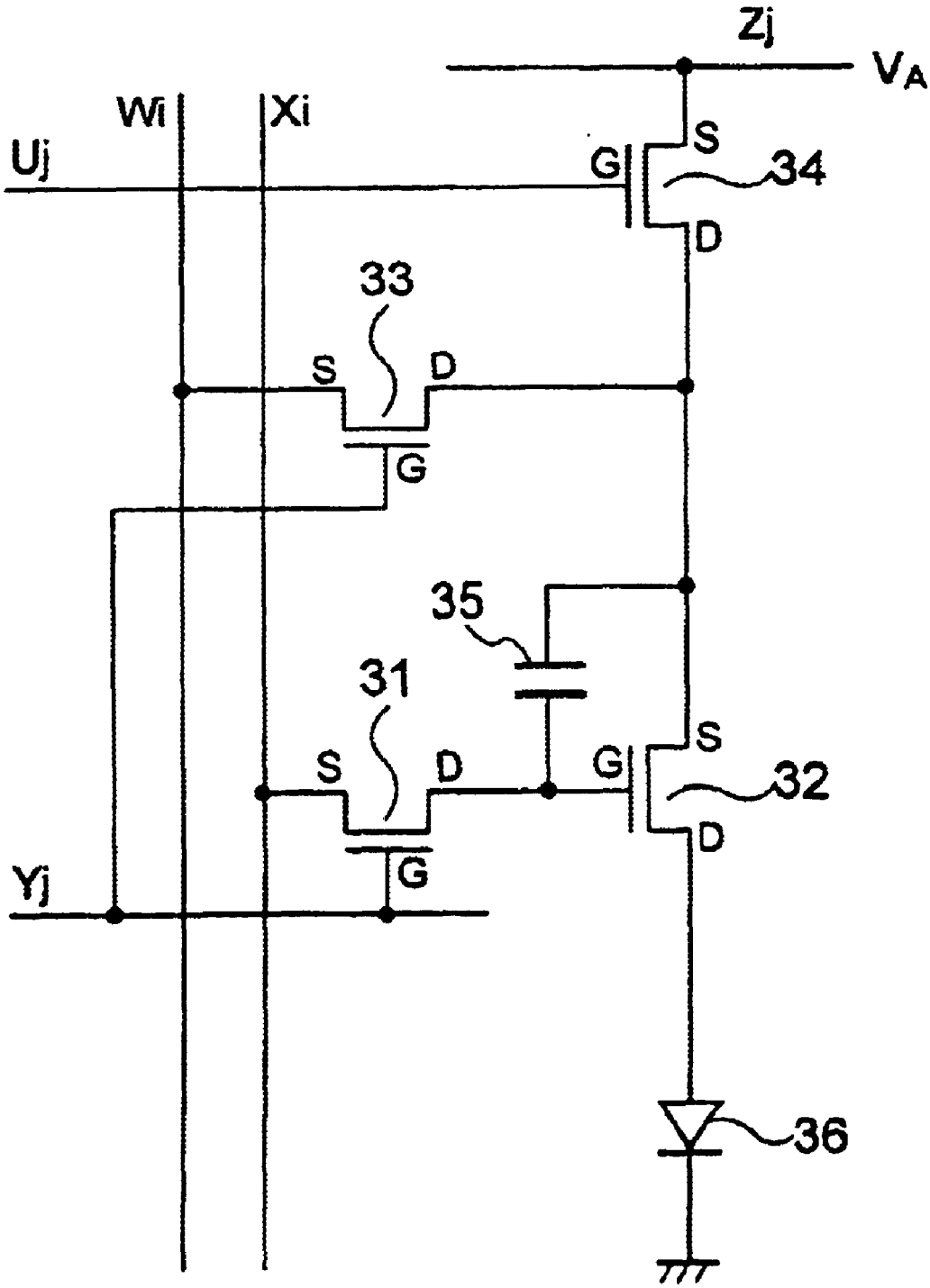
FIG. 7 is a circuit diagram showing the constitution of a pixel portion in the device of FIG. 6.

The pixel portions $PL_{1.1}$–$PL_{m.n}$ each have the same configuration, namely four FETs 31–34, a capacitor 35 and an organic EL element 36, as shown in FIG. 7. In the pixel portion shown in FIG. 7, the data line concerned therein is Xi, the power line is Wi, the scanning line is Yj, Uj, and the power line is Zj. The FET 31 has a gate connected to the scanning line Yj, whose source is connected to the data line Xi. The FET 31 has a drain connected with one end of the capacitor 35 and a gate of the FET 32. The other end of capacitor 35 and the source of the FET 32 are connected to respective drains of the FETs 33, 34. The FET 32 has a drain connected to an anode of the EL element 36. The EL element 36 has a cathode connected to the ground.

The FET 33 has a gate connected, together with the gate of the FET 31, to the scanning line Yj. The source of FET 33 is connected to the power line Wi. The FET 33 has a drain connected with the source of the FET 32, the drain of the FET 34 and the other end of the capacitor 35.

The FET 34 has a gate connected to the scanning line Uj and a source connected to the power line Zj.

The display panel 21 is connected to the scanning pulse supply circuit 25 through the scanning lines Y1–Yn, U1–Un, and to the data signal supply circuit 24 through the data lines X1–Xm and power lines W1–Wm. The controller 22 generates a scanning control signal and a data control signal, in order to control gray levels of the display panel 21 in accordance with an input image signal. The scanning control signal is supplied to the scanning pulse supply circuit 25 while the data control signal is supplied to the data signal supply circuit 24.

The scanning pulse supply circuit 25 is connected to the scanning lines Y1–Yn, U1–Un. The scanning pulse supply circuit 25 supplies a scanning pulse in predetermined intervals to the scanning lines Y1–Yn one by one in a predetermined order, and an inverted pulse of the scanning pulse to the scanning lines U1–Un, in accordance with the scanning control signal. The period during which one scanning pulse is generated is one scanning period.

The data signal supply circuit 24 is connected to the data lines X1–Xm and power lines W1–Wm, to generate pixel data pulses respectively for the pixel portions positioned on the scanning line to which a scanning pulse is supplied in accordance with the data control signal. The pixel data pulses, each of which is a data signal representative of a light-emitting luminance are respectively held in m buffer memories $\mathbf{40}_1$–$\mathbf{40}_m$ in the data signal supply circuit 24. The data signal supply circuit 24 supplies a pixel data pulse from each of the buffer memories $\mathbf{40}_1$–$\mathbf{40}_m$ to the pixel portion to be driven for light emission, through the corresponding data line X1–Xm. The pixel portion not to emit light is supplied with a pixel data pulse having a level not to cause the EL element to emit light.

The data signal supply circuit 24 has m luminance correcting circuits $\mathbf{41}_1$–$\mathbf{41}_m$, corresponding to the data line X1–Xm and power line W1–Wm.

Figure 8:
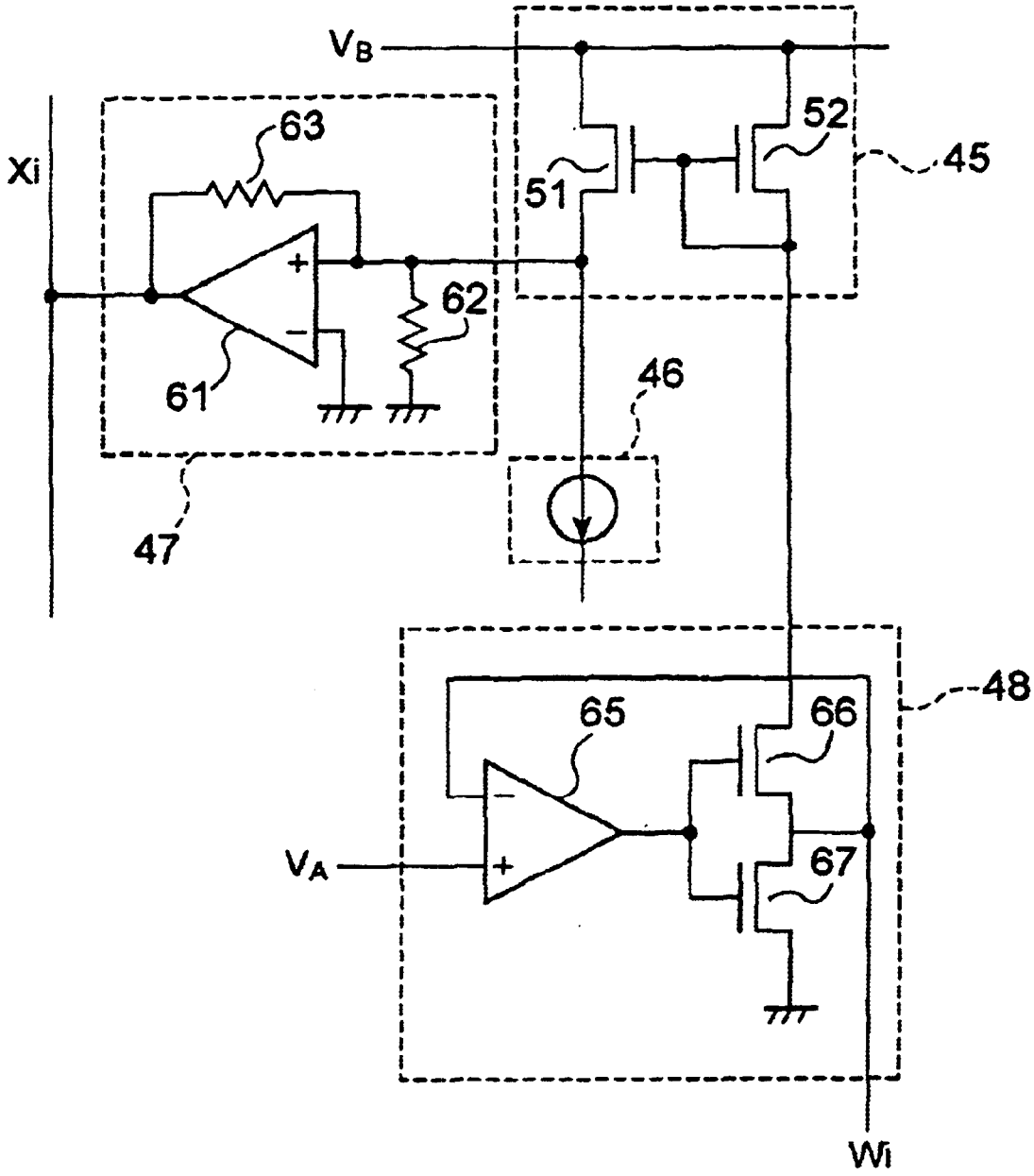
FIG. 8 is a diagram showing a luminance correcting circuit in the device of FIG. 6.

The luminance correcting circuits $\mathbf{41}_1$–$\mathbf{41}_m$ each have the same configuration, namely a current mirror circuit 45, a current source 46, a differential amplifier circuit 47 and a source-follower power source section 48, as shown in FIG. 8. In FIG. 8, the data line Xi, power line Wi, scanning lines Yj, Uj and power line Zj shown in FIG. 7 are used. The current mirror circuit 45 includes two FETs 51, 52, allowing the same amount of current as the amount of a current flowing to the FET 52 on the current input side to flow to the FET 51 on the output side. The current mirror circuit 45 has a current output end connected with the current source 46 and the differential amplifier circuit 47. The FETs 51, 52 have respective sources to be applied by a voltage VB higher than a power voltage VA.

The current source 46 outputs a predetermined value of current. The predetermined value is determined in accordance with a light-emitting luminance of the organic EL element 36. Namely, in the case of emitting light at a constant luminance, the predetermined value is a constant value. However, in the case of changing the light-emission luminance in accordance with a data signal level, the predetermined value is a value corresponding to each light-emission luminance, i.e. controlled by the controller 22.

The differential amplifier circuit 47 includes an operational amplifier 61 and resistances 62, 63. The differential amplifier circuit 47 has a non-inverted input terminal connected to the current output end of the current mirror circuit 45 and to the current source 46. The resistance 62 is connected between the non-inverted input terminal of differential amplifier 47 and the ground while the resistance 63 is connected between the non-inverted input terminal and the output terminal of the differential amplifier 47. The differential amplifier circuit 47 has an inverted input terminal being connected to the ground. The output terminal of the differential amplifier circuit 47 is connected to the data line Xi. The source-follower power source section 48 is formed by an operational amplifier 65 and two FETs 66, 67. The FETs 66, 67 constitute an inverter, wherein the FET 66 is a P-channel FET while the FET 67 is an N-channel FET. The FET 66 has a source connected to a current-input end of the current mirror circuit 45. The common-connected gates of the FET 66, 67 are connected to an output terminal of the operational amplifier 65. The drain of the FET 66 and the source of the FET 67 have a connection line connected to an inverted input terminal of the operational amplifier 65 and to the power line Wi. The drain of the FET 67 is connected to the ground. The non-inverted input terminal of the operational amplifier 65 is supplied with the power voltage VA from the power supply circuit 23.

Now, the operation of the circuit of FIGS. 7 and 8 is explained with reference to FIGS. 9 and 10. Explained herein is the operation that the display panel 21, particularly the j-th line (scanning line Yj) is scanned to cause light emission on the EL element 36.

Figure 9:
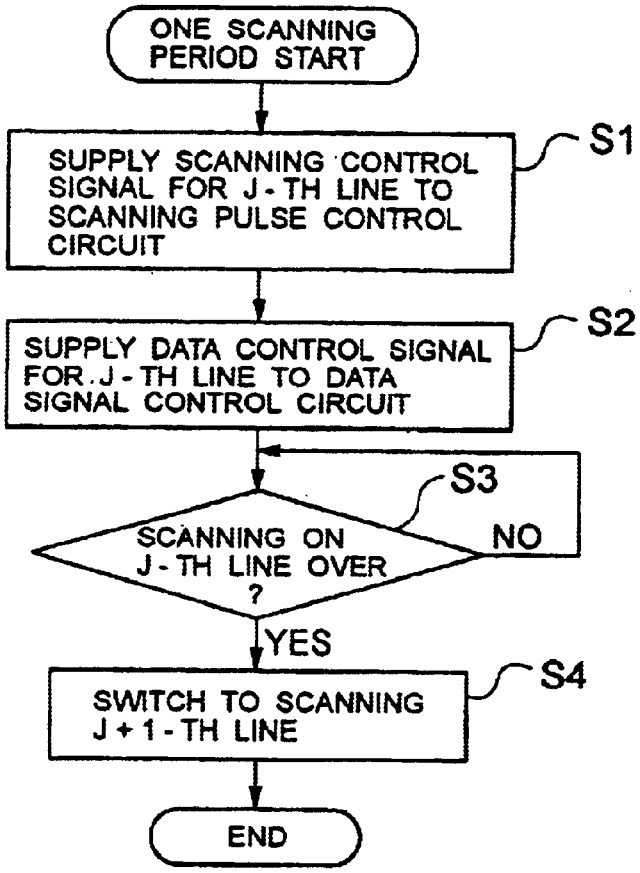
FIG. 9 is a flowchart showing an operation of a controller in each scanning period.
Figure 10:
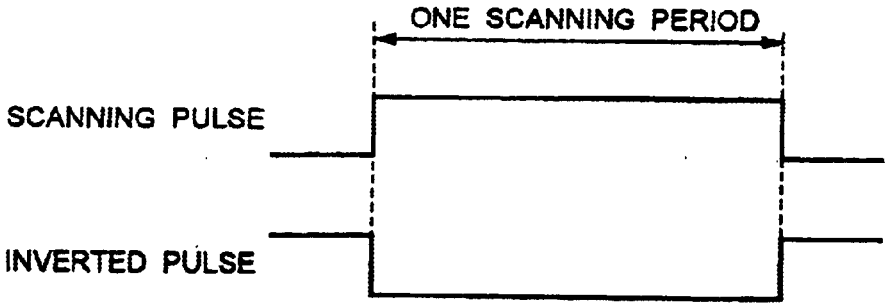
FIG. 10 is a figure showing a scanning pulse and an inverted pulse.

The controller 22, as shown in FIG. 9, supplies the scanning pulse supply circuit 25 with a scanning control signal for the j-th line in accordance with an image signal (step S1), and then supplies the data signal supply circuit 24 with a data control signal for the j-th line (step S2). Thus, the scanning pulse supply circuit 25 supplies a scanning pulse onto the scanning line Yj and an inverted pulse to that scanning pulse onto the scanning line Uj. In the data signal supply circuit 24, a pixel data pulse is held on the buffer memory.(40*i* of $\mathbf{40}_1$–$\mathbf{40}_m$: not shown), which is supplied onto the power source 46. The scanning pulse is a pulse indicating a high level throughout one scanning period. The inverted pulse indicates a low level in one scanning period. The pixel data pulse has a pulse voltage corresponding to a drive current supplied to the EL element 36.

Meanwhile, since the scanning pulse is supplied to the gates of the FET 31, 33, the FETs 31, 33 turn on. Since the inverted pulse is supplied to the gate of the FET 34, the FET 34 turns off.

Turning on the FET 33 provides a state that the voltage VA on the power line Wi is supplied to the source of the FET 32 through the source-drain of the FET 33.

By turning on the FET 31, the pixel data pulse is applied to the gate of the FET 32 and the capacitor 35 through the data line Xi and source-drain of the FET 31. By turning on the FET 32, a drive current based on the voltage VA over the power line Wi flows to the EL element 36 through the source-drain of the FET 32. This causes the EL element 36 to emit light. Meanwhile, the capacitor 35 is charged into a charge voltage corresponding to a voltage of the pixel data pulse.

At this time, the drive current to the EL element 36 flows from the FET 52 of the current mirror circuit 45 through the FET 66 of the source-follower power source section 48, the power line Wi, and the FETs 33 and 32. The FET 51 of the current mirror circuit 45 outputs a mirror current equal to the drive current as an output current of the FET 52. The mirror current flows to the current source 46. However, if the mirror current is greater than a predetermined value, the current in an extra amount exceeding the predetermined value flows to the differential amplifier circuit 47. If the mirror current is smaller than the predetermined value, the deficient amount of current flows from the differential amplifier circuit 47 to the current source 46. Since the output voltage of the differential amplifier circuit 47 is applied to the data line Xi, the voltage level of pixel data pulse is corrected such that the drive current becomes equal to the predetermined value.

Herein, provided that the drive current is Id and the predetermined value of current from the power source 46 is Ir, in the case of Id>Ir, a current Id–Ir flows from the FET 51 of the current mirror circuit 45 to the differential amplifier circuit 47, increasing the output voltage of the differential amplifier circuit 47, i.e. voltage on the data line Xi. The voltage on the data line Xi is applied to the gate of FET 32 and to one end of capacitor 35, through the FET 31. Since the source voltage of the FET 32 is constant at VA, decreased is a terminal-to-terminal voltage of capacitor 35 that is a gate-source voltage of the FET 32. Accordingly, the drive current Id decreases and becomes equal to a predetermined value of current Ir, thereby causing the EL element to emit light at a predetermined luminance. Meanwhile, in the case of Id<Ir, a current Ir–Id flows from the differential amplifier 47 to the current source 46, lowering the output voltage of the differential amplifier circuit 47, i.e. voltage on the data line Xi. The voltage on the data line Xi is applied to the gate of FET 32 and to one end of capacitor 35, through the FET 31. Since the source voltage of the FET 32 is constant at VA, increased is a terminal-to-terminal voltage of the capacitor 35 that is a gate-source voltage of the FET 32. Accordingly, the drive current Id increases and becomes equal to a predetermined value of current Ir, thereby causing the EL element 36 to emit light at a predetermined luminance.

When the scanning period on the j-line is over, the j-line enters in a light-emission maintaining period. In the light-emission maintaining period, the scanning pulse supply circuit 25 vanishes the scanning pulse supplied on the scanning line Yj, thus turning off the FETs 31, 33. Simultaneously with vanishing the scanning pulse, the inverted pulse is vanished away. Since the level of scanning line Uj becomes a high level, the FET 34 turns on. The data signal supply circuit 24 resets the holding of the pixel data pulse being supplied on the data line Xi.

Since the capacitor 35 maintains its terminal-to-terminal voltage as a charge voltage thereof, the FET 32 continuously supplies a drive current Id equal to the predetermined value current Ir to the EL element 36, to cause the EL element to emit light. In the light-emission maintaining period, the drive current Id flows from the power line Zj to the EL element 36 through the source-drain of the FET 34 and the source-drain of the FET 32. In the case that the terminal-to-terminal voltage of the capacitor 35 is corrected in the scanning period, the terminal-to-terminal voltage of the capacitor 35 is maintained also in the light-emission maintaining period by the corrected voltage. Accordingly, the light-emitting luminance on the EL element 36 is maintained at a predetermined luminance of immediately before ending the scanning period. The pixel portions on the j-th line are in a light-emission maintaining period until the next scanning period comes.

The controller 22, when the scanning period on the j-th line is over (step S3), switches to the next operation on the (j+1)-th line (step S4). When the scanning periods for n lines are over, the controller 22 switches to the operation in a scanning period on the first line. The operation in each scanning period is the same as the operation shown in the foregoing steps S1–S3. The steps S1–S3 are repeated in each scanning period.

Accordingly, according to the above embodiment, even when the internal resistance value of an EL element is varied due to manufacturing variation, environment temperature change or cumulative light-emission time, the luminance level on the entire screen of the display panel 1 can be always maintained within a desired luminance range.

Incidentally, although the above embodiment showed the display device using organic EL elements as light-emitting elements, the light-emitting element is not limited to that, i.e. a display device using other light-emitting elements may be applied to the invention.

Meanwhile, although the above embodiment supplies a scanning pulse onto the gate of the pixel FET 31, 33 through the scanning line Yj and an inverted pulse onto the gate of FET 34 through the scanning line Uj, the pulses may be supplied to the FETs 31, 33, 34 through independent scanning lines. Alternatively, instead of providing a scanning line Uj, the scanning pulse may be inverted by an inverter within a pixel, to generate an inverted pulse to be supplied to the gate of the FET 34.

As described above, each pixel portion has a holding device for holding a data signal and a pixel controller for activating a driving element in accordance with a data signal held in the holding device and causing the driving element to supply to the light emitting element a driving current in an amount corresponding to the data signal. A display controller has a drive current detector for detecting a drive current in a scanning period and a data correcting device for correcting a data signal held in the holding device such that a drive current detected in a scanning period by the driving current detector becomes equal to a current corresponding to a light-emission luminance represented by the data signal. Accordingly, gray level display can be correctly carried out even during a use over a long time.

This application is based on a Japanese Patent Application No. 2002-285706 which is hereby incorporated by reference.

What is claimed is:

1. An active type of display panel having a plurality of pixel portions which are each formed by a series circuit having a light-emitting element and a driving element and divided into a plurality of groups, the display panel comprising:

a reference potential line connected to one end of the series circuit of the plurality of pixel portions;

a first power line provided in common for the plurality of pixel portions; and a second power line provided for each of the plurality of groups;

wherein each of the plurality of pixel portions has a switch device for electrically connecting between the other end of the series circuit and the first power line, and electrically connecting between the other end of the series circuit and the second power line of a corresponding group of the plurality of pixel portions.

2. A display panel according to claim 1, wherein the switch device includes a first switch element provided between the other of the series circuit and the first power line and a second switch element provided between the other end of the series circuit and the second power line of the corresponding group of the plurality of pixel portions.

3. A display panel according to claim 1, further comprising a plurality of data lines arranged as columns corresponding to the plurality of groups and a plurality of scanning lines arranged in rows to intersect with the plurality of data lines, wherein the pixel portions are arranged at the respective intersections between the plurality of data lines and the plurality of scanning lines, and wherein each of the plurality of pixel portions has a capacitor, a first field-effect transistor as the driving element having a gate and a source between which the capacitor is connected, an organic electroluminescent element as the light-emitting element having an anode connected to a drain of the first field-effect transistor and a cathode connected to the referential potential line, a second field-effect transistor having a gate connected to the scanning line on a corresponding row of the plurality of scanning lines, a Source connected to the data line on a corresponding column of the plurality of data lines and a drain connected to the gate of the first field-effect transistor, a third field-effect transistor having a gate connected to the scanning line on the corresponding row, a source connected to the second power line on the corresponding column and a drain connected to the source of the first field-effect transistor, and a fourth field-effect transistor having a gate which is at a level inverted of a level on the gate of the third field-effect transistor, a source connected to the first power line and a drain connected to the source of the first field-effect transistor.

4. A display device comprising:

an active type of display panel having a plurality of data lines arranged in columns, a plurality of scanning lines arranged in rows to intersect with the plurality of data lines, and pixel portions arranged at the respective intersections between the plurality of data lines and the plurality of scanning lines, each of the pixel portions including a series circuit which has a light-emitting element and a driving element; and a display controller, in accordance with an input image signal, for sequentially designating one scanning line of the plurality of scanning lines in predetermined intervals, supplying a scanning pulse to the one scanning line, and supplying a data signal representative of a light-emission luminance onto at least one data line of the plurality of data lines in a scanning period when the scanning pulse is supplied to the one scanning line;

wherein each of the pixel portions has a holding device which holds the data signal, and a pixel controller which activates the driving element in accordance with the data signal held in the holding device, to supply a drive current at a level corresponding to the data signal to the light-emitting element; and wherein the display controller has a drive current detector which detects the drive current in the scanning period, and a data correcting device which corrects the data signal held in the holding device such that the drive current detected in the scanning period by the drive current detector becomes equal to a current level corresponding to a light-emitting luminance represented by the data signal.

5. A display device according to claim 4, wherein the display panel has a reference potential line connected to one ends of the series circuit of the plurality of pixel portions, a first power line to which a power voltage is applied with the reference potential line, and a second power line which is provided for each of the plurality of data lines and to which, with the reference potential line, a voltage equal to the power voltage is applied by the current detector;

wherein the holding device has a capacitor;

wherein the driving element is a first field-effect transistor having a gate and a source between which the capacitor is connected;

wherein the light-emitting element is an organic electroluminescent element having an anode connected to a drain of the first field-effect transistor and a cathode connected to the reference potential line;

wherein the pixel controller has a second field-effect transistor having a gate connected to the scanning line on a corresponding row of the plurality of scanning lines, a source connected to the data line on a corresponding column of the plurality of data lines and a drain connected to the gate of the first field-effect transistor, a third field-effect transistor having a gate connected to the scanning line on the corresponding row, a source connected to the second power line on the corresponding column and a drain connected to a source of the first field-effect transistor, and a fourth field-effect transistor having a gate which is at a level inverted of a level on the gate of the third field-effect transistor, a source connected to the first power line and a drain connected to the source of the first field-effect transistor; and wherein the drive current, in the scanning period, is supplied to the organic electroluminescent element through the second power line on a corresponding column, a source-to-drain of the third field-effect transistor and a source-to-drain of the first field-effect transistor, while the drive current, in other than the scanning period, is supplied to the organic electroluminescent element through the first power line, a source-to-drain of the fourth field-effect transistor and the source-to-drain of the first field-effect transistor.

6. A display device according to claim 4, wherein the drive current detector includes a source-follower power source section which outputs the drive current at a voltage equal to a power voltage to be applied to the pixel portion, and a current mirror circuit which serves as a current source for the drive current to be outputted by the source-follower power source section and outputs a mirror current equal to the drive current as a detection drive current.

7. A display device according to claim 4, wherein the data correcting device includes:

a difference current detector which detects a difference current between the drive current detected by the drive current detector and a predetermined current, a correcting-voltage generator which outputs a correcting voltage to decrease the difference current, and a supply device which supplies the correcting voltage to the pixel controller through the data line on the corresponding column.

8. A method for driving an active type of display panel having a plurality of data lines arranged in columns, a plurality of scanning lines arranged in rows to intersect with the plurality of data lines, and pixel portions arranged at respective intersections between the plurality of data lines and the plurality of scanning lines, each of the pixel portions including a series circuit which has a light-emitting element and a driving element, the driving method comprising the steps of:

in accordance with an input image signal, sequentially designating one scanning line of the plurality of scanning lines in predetermined intervals, supplying a scanning pulse to the one scanning line, and supplying a data signal representative of a light-emission luminance onto at least one data line of the plurality of data lines in a scanning period when the scanning pulse is supplied to the one scanning line;

holding the data signal in each of the pixel portions;

activating the driving element in accordance with the held data signal, to supply a drive current at a level corresponding to the data signal to the light-emitting element;

detecting the drive current in the scanning period, and correcting the held data signal such that the drive current detected in the scanning period becomes equal to a current level corresponding to a light-emitting luminance represented by the data signal.

* * * * *